US009863189B2

(12) United States Patent
Stockey et al.

(10) Patent No.: US 9,863,189 B2
(45) Date of Patent: Jan. 9, 2018

(54) CUTTING ELEMENTS COMPRISING PARTIALLY LEACHED POLYCRYSTALLINE MATERIAL, TOOLS COMPRISING SUCH CUTTING ELEMENTS, AND METHODS OF FORMING WELLBORES USING SUCH CUTTING ELEMENTS

(71) Applicant: Baker Hughes Incorporated, Houston, TX (US)

(72) Inventors: David A. Stockey, The Woodlands, TX (US); Alejandro Flores, The Woodlands, TX (US); Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 256 days.

(21) Appl. No.: 14/329,380

(22) Filed: Jul. 11, 2014

(65) Prior Publication Data

US 2016/0010397 A1 Jan. 14, 2016

(51) Int. Cl.
*E21B 10/567* (2006.01)
*E21B 7/00* (2006.01)
(Continued)

(52) U.S. Cl.
CPC ..... *E21B 10/567* (2013.01); *E21B 7/00* (2013.01); *E21B 10/5676* (2013.01);
(Continued)

(58) Field of Classification Search
USPC ..... 175/57, 434
See application file for complete search history.

(56) References Cited

U.S. PATENT DOCUMENTS 4,224,380 A 9/1980 Bovenkerk et al.
5,011,515 A 4/1991 Frushour
(Continued)

FOREIGN PATENT DOCUMENTS

AU 2005243867 A1 11/2005
CA 2566597 A1 11/2005
(Continued)

OTHER PUBLICATIONS

Scott et al., U.S. Appl. No. 13/783,118, entitled Cutting Elements Leached to Different Depths Located in Different Regions of an Earth-Boring Tool and Related Methods, filed Mar. 1, 2013.
(Continued)

*Primary Examiner* — Taras P Bemko
(74) *Attorney, Agent, or Firm* — TraskBritt

(57) ABSTRACT

An earth-boring tool includes a cutting element having a first volume of polycrystalline material including catalyst material and a second volume free of catalyst material. A boundary between the first volume and the second volume is nonlinear in a cross-sectional plane that includes a centerline of the cutting element and an anticipated point of contact of the cutting element with the surface of the formation to be cut. Each line tangent the boundary in the cross-sectional plane forms an angle with the centerline of the cutting element greater than the contact back rake angle of the cutting element. In some cutting elements, some portions of the boundary may have another selected shape. Some cutting elements have a boundary wherein tangent lines form angles of greater than 20° with the centerline of the cutting element. Methods of forming wellbores are also disclosed.

20 Claims, 10 Drawing Sheets

(51) Int. Cl.
*E21B 10/573* (2006.01)
*B22F 5/00* (2006.01)
*C22C 26/00* (2006.01)

(52) U.S. Cl.
CPC .... *E21B 10/5735* (2013.01); *B22F 2005/001* (2013.01); *C22C 26/00* (2013.01)

(56) References Cited

U.S. PATENT DOCUMENTS

| | | | |
|---|---|---|---|
| 5,127,923 | A | 7/1992 | Bunting et al. |
| 5,172,778 | A | 12/1992 | Tibbitts et al. |
| 5,472,376 | A | 12/1995 | Olmstead et al. |
| 5,605,198 | A | 2/1997 | Tibbitts et al. |
| 5,669,271 | A | 9/1997 | Griffin et al. |
| 5,709,279 | A | 1/1998 | Dennis |
| 5,711,702 | A | 1/1998 | Devlin |
| 5,787,022 | A | 7/1998 | Tibbitts et al. |
| 5,829,541 | A | 11/1998 | Flood et al. |
| 5,862,873 | A | 1/1999 | Matthias et al. |
| 5,906,246 | A | 5/1999 | Mensa-Wilmot et al. |
| 5,950,747 | A | 9/1999 | Tibbitts et al. |
| 6,011,232 | A | 1/2000 | Matthias |
| 6,021,859 | A | 2/2000 | Tibbitts et al. |
| 6,045,440 | A | 4/2000 | Johnson et al. |
| 6,193,001 | B1 | 2/2001 | Eyre et al. |
| 6,202,772 | B1 | 3/2001 | Eyre et al. |
| 6,601,662 | B2 | 8/2003 | Matthias et al. |
| 6,991,049 | B2 | 1/2006 | Eyre et al. |
| 7,165,636 | B2 | 1/2007 | Eyre et al. |
| 7,533,740 | B2 | 5/2009 | Zhang |
| 7,712,553 | B2 | 5/2010 | Shamburger |
| 8,172,012 | B2 | 5/2012 | Achilles |
| 8,197,936 | B2 | 6/2012 | Keshavan |
| 8,277,722 | B2 | 10/2012 | DiGiovanni |
| 8,353,371 | B2 | 1/2013 | Cooley et al. |
| 8,535,400 | B2 | 9/2013 | Belnap et al. |
| 8,567,531 | B2 | 10/2013 | Belnap et al. |
| 8,721,752 | B2 | 5/2014 | Fuller et al. |
| 8,764,864 | B1 | 7/2014 | Miess et al. |
| 8,783,389 | B2 | 7/2014 | Fan et al. |
| 8,800,692 | B2 | 8/2014 | Scott et al. |
| 8,821,604 | B2 | 9/2014 | Sani |
| 8,839,889 | B2 | 9/2014 | DiGiovanni et al. |
| 8,899,358 | B2 | 12/2014 | Yu et al. |
| 8,978,789 | B1 | 3/2015 | Sani et al. |
| 8,985,248 | B2 | 3/2015 | DiGiovanni et al. |
| 8,999,025 | B1 | 4/2015 | Miess et al. |
| 9,103,172 | B1 | 8/2015 | Bertagnolli et al. |
| 9,316,059 | B1 | 4/2016 | Topham et al. |
| 2001/0003932 | A1 | 6/2001 | Packer |
| 2002/0071729 | A1 | 6/2002 | Middlemiss et al. |
| 2002/0074168 | A1 | 6/2002 | Matthias et al. |
| 2002/0079140 | A1 | 6/2002 | Eyre et al. |
| 2003/0037964 | A1* | 2/2003 | Sinor ..... E21B 10/43 175/57 |
| 2003/0079918 | A1 | 5/2003 | Eyre et al. |
| 2006/0165993 | A1 | 7/2006 | Keshavan |
| 2007/0039762 | A1 | 2/2007 | Achilles |
| 2007/0144790 | A1 | 6/2007 | Fang et al. |
| 2008/0206576 | A1 | 8/2008 | Qian et al. |
| 2009/0022952 | A1 | 1/2009 | Keshavan |
| 2010/0012389 | A1 | 1/2010 | Zhang et al. |
| 2010/0186304 | A1 | 7/2010 | Burgess et al. |
| 2010/0236837 | A1 | 9/2010 | Achilles |
| 2010/0242375 | A1 | 9/2010 | Hall et al. |
| 2010/0288564 | A1 | 11/2010 | Dovalina et al. |
| 2010/0320006 | A1 | 12/2010 | Fan et al. |
| 2011/0042149 | A1 | 2/2011 | Scott et al. |
| 2011/0088950 | A1 | 4/2011 | Scott et al. |
| 2011/0120782 | A1 | 5/2011 | Cooley et al. |
| 2011/0171414 | A1 | 7/2011 | Sreshta et al. |
| 2011/0174549 | A1 | 7/2011 | Dolan et al. |
| 2011/0212303 | A1 | 9/2011 | Fuller et al. |
| 2011/0259642 | A1 | 10/2011 | DiGiovanni et al. |
| 2011/0259648 | A1 | 10/2011 | Sani |
| 2011/0266059 | A1 | 11/2011 | DiGiovanni et al. |
| 2012/0037431 | A1 | 2/2012 | DiGiovanni et al. |
| 2012/0080239 | A1 | 4/2012 | Lyons et al. |
| 2012/0097457 | A1 | 4/2012 | Setlur et al. |
| 2012/0103700 | A1 | 5/2012 | Lin |
| 2012/0222363 | A1 | 9/2012 | DiGiovanni et al. |
| 2012/0222364 | A1 | 9/2012 | Lyons et al. |
| 2012/0225277 | A1 | 9/2012 | Scott |
| 2013/0068534 | A1 | 3/2013 | DiGiovanni et al. |
| 2013/0068537 | A1 | 3/2013 | DiGiovanni |
| 2013/0068538 | A1 | 3/2013 | DiGiovanni et al. |
| 2013/0092454 | A1 | 4/2013 | Scott et al. |
| 2013/0292184 | A1* | 11/2013 | Weaver ..... B24D 99/005 175/374 |
| 2014/0060937 | A1 | 3/2014 | Konovalov et al. |
| 2014/0069726 | A1 | 3/2014 | Mumma et al. |
| 2014/0134403 | A1 | 5/2014 | Gledhill |
| 2014/0166371 | A1 | 6/2014 | Whittaker |
| 2015/0021100 | A1 | 1/2015 | Cheng |
| 2015/0129321 | A1 | 5/2015 | Sani |
| 2015/0259986 | A1 | 9/2015 | Stockey |
| 2015/0266163 | A1 | 9/2015 | Stockey et al. |
| 2016/0002982 | A1 | 1/2016 | Mukhopadhyay et al. |
| 2016/0230471 | A1 | 8/2016 | Gonzalez et al. |
| 2016/0318808 | A1 | 11/2016 | Kasonde et al. |
| 2016/0325404 | A1 | 11/2016 | Long et al. |
| 2016/0326809 | A1 | 11/2016 | Long et al. |
| 2016/0339561 | A1 | 11/2016 | Vail |

FOREIGN PATENT DOCUMENTS

| | | | |
|---|---|---|---|
| CA | 2566597 | C | 11/2011 |
| EP | 1750876 | B1 | 7/2011 |
| WO | 2005110648 | A2 | 11/2005 |
| WO | 2009024752 | A2 | 2/2009 |
| WO | 2012145586 | A1 | 10/2012 |

OTHER PUBLICATIONS

Underwood, Ervin E., Quantitative Stereology, Addison-Wesley Publishing Company, Inc., 1970, 20 pages.

Digiovanni et al., U.S. Appl. No. 14/248,008, entitled Cutting Elements Having a Non-Uniform Annulus Leach Depth, Earth-Boring Tools Including Such Cutting Elements, and Related Methods, filed Apr. 8, 2014.

Stockey et al., U.S. Appl. No. 14/248,068, entitled Cutting Elements Including Undulating Boundaries Between Catalyst-Containg and Catalyst-Free Regions of Polycrystalline Superabrasive Materials and Related Earth-Boring Tools and Methods, filed Apr. 8, 2014.

Stockey, David A., U.S. Appl. No. 14/215,786, entitled Cutting Elements Having Non-Planar Cutting Faces With Selectively Leached Regions, Earth-Boring Tools Including Such Cutting Elements, and Related Methods, filed Mar. 17, 2014.

Cheng, U.S. Appl. No. 13/947,723, entitled Thermally Stable Polycrystalline Compacts For Reduced Spalling Earth-Boring Tools Including Such Compacts, and Related Methods, filed Jul. 22, 2013.

Cheng, Xiaomin Chris, U.S. Appl. No. 13/947,723 titled Thermally Stable Polycrystalline Compacts for Reduced Spalling Earth-Boring Tools Including Such Compacts, and Related Methods, filed Jul. 22, 2013.

Stockey et al., U.S. Appl. No. 14/248,068 titled Cutting Elements including Undulating Boundaries Between Catalyst-Containing and Catalyst-Free Regions of Polycrystalline Superabrasive Materials and Related Earth-Boring Tools and Methods, filed Apr. 8, 2014.

International Search Report for PCT/US2015/039766, dated Sep. 30, 2015, 3 pages.

Written Opinion of the International Searching Authority for PCT/US2015/039766, dated Sep. 30, 2015, 7 pages.

* cited by examiner

CUTTING ELEMENTS COMPRISING PARTIALLY LEACHED POLYCRYSTALLINE MATERIAL, TOOLS COMPRISING SUCH CUTTING ELEMENTS, AND METHODS OF FORMING WELLBORES USING SUCH CUTTING ELEMENTS

CROSS-REFERENCE TO RELATED APPLICATIONS

The subject matter of this application is related to the subject matter of U.S. patent application Ser. No. 13/947,723, filed Jul. 22, 2013, now U.S. Pat. No. 9,534,450, issued Jan. 3, 2017, entitled "THERMALLY STABLE POLYCRYSTALLINE COMPACTS FOR REDUCED SPALLING, EARTH-BORING TOOLS INCLUDING SUCH COMPACTS, AND RELATED METHODS;" U.S. patent application Ser. No. 14/248,068, filed Apr. 8, 2014, now U.S. Pat. No. 9,605,488, issued Mar. 28, 2017, entitled "CUTTING ELEMENTS INCLUDING UNDULATING BOUNDARIES BETWEEN CATALYST-CONTAINING AND CATALYST-FREE REGIONS OF POLYCRYSTALLINE SUPERABRASIVE MATERIALS AND RELATED EARTH-BORING TOOLS AND METHODS;" U.S. patent application Ser. No. 14/248,008, filed Apr. 8, 2014, entitled "CUTTING ELEMENTS HAVING A NON-UNIFORM ANNULUS LEACH DEPTH, EARTH-BORING TOOLS INCLUDING SUCH CUTTING ELEMENTS, AND RELATED METHODS;" U.S. patent application Ser. No. 14/215,786, filed Mar. 17, 2014, entitled "CUTTING ELEMENTS HAVING NONPLANAR CUTTING FACES WITH SELECTIVELY LEACHED REGIONS, EARTH-BORING TOOLS INCLUDING SUCH CUTTING ELEMENTS, AND RELATED METHODS;" and U.S. patent application Ser. No. 14/329,380, filed Jul. 11, 2014, entitled "CUTTING ELEMENTS COMPRISING PARTIALLY LEACHED POLYCRYSTALLINE MATERIAL, TOOLS COMPRISING SUCH CUTTING ELEMENTS, AND METHODS OF FORMING WELLBORES USING SUCH CUTTING ELEMENTS."

FIELD

Embodiments of the present disclosure relate generally to cutting elements for earth-boring tools. More specifically, disclosed embodiments relate to polycrystalline superabrasive materials for use in cutting elements for earth-boring tools, which polycrystalline superabrasive materials may have catalyst materials removed from one or more selected regions thereof.

BACKGROUND

Earth-boring tools for forming wellbores in subterranean earth formations may include cutting elements secured to a body. For example, fixed-cutter, earth-boring rotary drill bits (also referred to as "drag bits") include cutting elements that are fixedly attached to a body of the drill bit. Roller-cone earth-boring rotary drill bits include cones that are mounted on bearing pins extending from legs of a body such that each cone is capable of rotating about the bearing pin on which it is mounted. Cutting elements may be mounted to each cone of the drill bit.

The cutting elements used in such earth-boring tools are often polycrystalline diamond compact (often referred to as "PDC") cutting elements, also termed "cutters." PDC cutting elements include a polycrystalline diamond (PCD) material, which may be characterized as a superabrasive or superhard material. Such polycrystalline diamond materials are formed by sintering and bonding together small diamond grains (e.g., diamond crystals), termed "grit," under conditions of high temperature and high pressure in the presence of a catalyst material to form polycrystalline diamond. The polycrystalline diamond is frequently in the shape of a disc, also called a "diamond table." The processes used to from polycrystalline diamond are often referred to as high temperature/high pressure ("HTHP") processes.

PDC cutting elements frequently include a substrate to which the polycrystalline diamond is secured. The cutting element substrate may be formed of a ceramic-metallic composite material (i.e., a cermet), such as cobalt-cemented tungsten carbide. In some instances, the polycrystalline diamond table may be formed on the substrate, for example, during the HTHP sintering process. In such instances, cobalt or other metal solvent catalyst material in the cutting element substrate (e.g., a metal matrix of the ceramic-metallic composite material) may be swept among the diamond grains during sintering and serve as a catalyst for forming a diamond table from the diamond grains. Powdered catalyst material may also be mixed with the diamond grains prior to sintering the grains together in an HTHP process. In other methods, however, the diamond table may be formed separately from the cutting element substrate and subsequently attached thereto.

To reduce problems associated with differences in thermal expansion and chemical breakdown of the diamond crystals in PDC cutting elements, "thermally stable" polycrystalline diamond compacts (which are also known as thermally stable products or "TSPs") have been developed. Such a thermally stable polycrystalline diamond compact may be formed by removing catalyst material out from interstitial spaces among the interbonded grains in the diamond table (e.g., by leaching catalyst material from the diamond table using an acid). Diamond tables that have been at least substantially fully leached are relatively more brittle and vulnerable to shear, compressive, and tensile stresses than are unleached diamond tables. In addition, it may be difficult to secure a completely leached diamond table to a supporting substrate. To provide cutting elements having diamond tables that are more thermally stable relative to unleached diamond tables, but that are also relatively less brittle and vulnerable to shear, compressive, and tensile stresses than fully leached diamond tables, cutting elements have been provided that include a diamond table in which the catalyst material has been leached from only a portion or portions of the diamond table. For example, it is known to leach catalyst material from the cutting face, from the side of the diamond table, or both, to a desired depth within the diamond table, but without leaching all of the catalyst material out from the diamond table.

FIG. 1 is a simplified cross-sectional side view illustrating a cutting element 10 having some of the catalyst material leached therefrom. The cutting element 10 includes a substrate 12 and a diamond table 13. The diamond table 13 includes an unleached portion 14 and a leached portion 16, with a boundary 18 between the unleached portion 14 and the leached portion 16. The diamond table 13 may have a chamfer 20 and a cutting face 22. The interface 18 is shaped to generally correspond to the shape of the chamfer 20 and the cutting face 22. To form the partially leached cutting element 10 of FIG. 1, portions of the diamond table 13 and the substrate 12 may be masked, and the cutting element 10 may be placed in an acid bath, with the substrate 12 and a portion of the sidewall adjacent the substrate 12 masked to prevent leaching of a portion of the sidewall and acid damage to the substrate 12.

FIGS. 2A through 2C are perspective views illustrating how the cutting element 10 may appear after use in cutting a subterranean formation. A wear scar 24 (i.e., a surface formed by the removal of material of the cutting element 10) may begin to appear at an edge of the cutting element 10, beginning with the leached portion 16 of the diamond table 13 (FIG. 2A). As the wear scar 24 grows larger, some of the unleached portion 14 of the diamond table 13 may become exposed, surrounded by the leached portion 16 (FIG. 2B) in an aperture therethrough. After additional wear, the exposed part of the unleached portion 14 of the diamond table 13 may merge with the part of the unleached portion 14 exposed lower down the side surface of the cutting element 10 (FIG. 2C). As shown in FIG. 2C, protruding areas 26 of the leached portion 16 may extend toward one another within the wear scar 24, partially defining an alcove 28 of the unleached portion 14. As the wear scar 24 enlarges, the shape of the alcove 28 and the protruding areas 26 may change dramatically, altering the cutting performance of the cutting element 10. Surfaces of the leached portion 16 may be radially disconnected from one another (i.e., in a plane extending from the centerline of the cutting element 10) by a newly exposed portion of the unleached portion 14 during use.

BRIEF SUMMARY

In some embodiments, an earth-boring tool includes a bit body and a cutting element secured to the bit body. The cutting element exhibits a contact back rake angle with respect to a surface of a formation to be cut by the bit body and comprises a polycrystalline superabrasive material. The polycrystalline superabrasive material comprises a first volume including catalyst material in interstitial spaces among interbonded grains of the polycrystalline superabrasive material, a second volume at least substantially free of catalyst material in the interstitial spaces among the interbonded grains of the polycrystalline superabrasive material, and a continuous boundary between the first volume and the second volume of the polycrystalline superabrasive material. The boundary is nonlinear in a cross-sectional plane that includes a centerline of the cutting element and an anticipated point of contact of the cutting element with the surface of the formation to be cut by the earth-boring tool. Each line tangent the boundary in the cross-sectional plane forms an angle with the centerline of the cutting element greater than the contact back rake angle of the cutting element.

In certain embodiments, an earth-boring tool includes a bit body and a cutting element secured to the bit body. The cutting element exhibits a contact back rake angle with respect to a surface of a formation to be cut by the bit body and comprises a polycrystalline superabrasive material. The polycrystalline superabrasive material comprises a first volume including catalyst material in interstitial spaces among interbonded grains of the polycrystalline superabrasive material, a second volume at least substantially free of catalyst material in the interstitial spaces among the interbonded grains of the polycrystalline superabrasive material, and a boundary between the first volume and the second volume of the polycrystalline superabrasive material. The boundary comprises a first area and a second area. The first area includes a portion of the boundary within a first radial distance of a centerline of the cutting element in a cross-sectional plane that includes the centerline of the cutting element and an anticipated point of contact of the cutting element with the surface of the formation to be cut by the earth-boring tool. The second area includes a portion of the boundary between the first radial distance from the centerline of the cutting element and a second radial distance from the centerline of the cutting element in the cross-sectional plane. The second radial distance corresponds to an exterior surface of the cutting element, and the first radial distance is at least 50% of the second radial distance. Each line tangent to the boundary in the cross-sectional plane in the second area forms an angle with a centerline of the cutting element greater than the contact back rake angle of the cutting element.

In other embodiments, a cutting element for an earth-boring tool includes a substrate and a polycrystalline superabrasive material secured to the substrate. The polycrystalline superabrasive material comprises a first volume including catalyst material in interstitial spaces among interbonded grains of the polycrystalline superabrasive material, a second volume at least substantially free of catalyst material in the interstitial spaces among the interbonded grains of the polycrystalline superabrasive material, and a boundary between the first volume and the second volume of the polycrystalline superabrasive material. The boundary is nonlinear in a cross-sectional plane that includes a centerline of the cutting element and an anticipated point of contact of the cutting element with the surface of the formation to be cut by the cutting element. Each line tangent the boundary in the cross-sectional plane forms an angle with the centerline of greater than 20°.

A method of forming a wellbore may include contacting an earth-boring tool with a surface of a subterranean formation. The earth-boring tool comprises a bit body and at least one cutting element secured to the bit body. The at least one cutting element comprises a polycrystalline superabrasive material comprising a first volume including catalyst material in interstitial spaces among interbonded grains of the polycrystalline superabrasive material and a second volume at least substantially free of catalyst material in interstitial spaces among interbonded grains of the polycrystalline superabrasive material. A surface of the second volume is exposed at least partially around the cutting element. The method further comprises removing at least a portion of the polycrystalline superabrasive material from the second volume through contact with the surface of the subterranean formation and removing a portion of the first volume adjacent to and in contact with the second volume without rendering a portion of the second volume radially discontinuous with a remainder of the second volume.

Other methods of forming a wellbore may include contacting an earth-boring tool with a surface of a subterranean formation. The earth-boring tool comprises a bit body and a cutting element secured to the bit body. The cutting element comprises a polycrystalline superabrasive material comprising a first volume including catalyst material in interstitial spaces among interbonded grains of the polycrystalline superabrasive material and a second volume at least substantially free of catalyst material in the interstitial spaces among the interbonded grains of the polycrystalline superabrasive material. A surface of the second volume is exposed at least partially around the cutting element. The method further comprises removing a portion of the second volume and removing a portion of the first volume without exposing the first volume through an aperture formed in the second volume.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
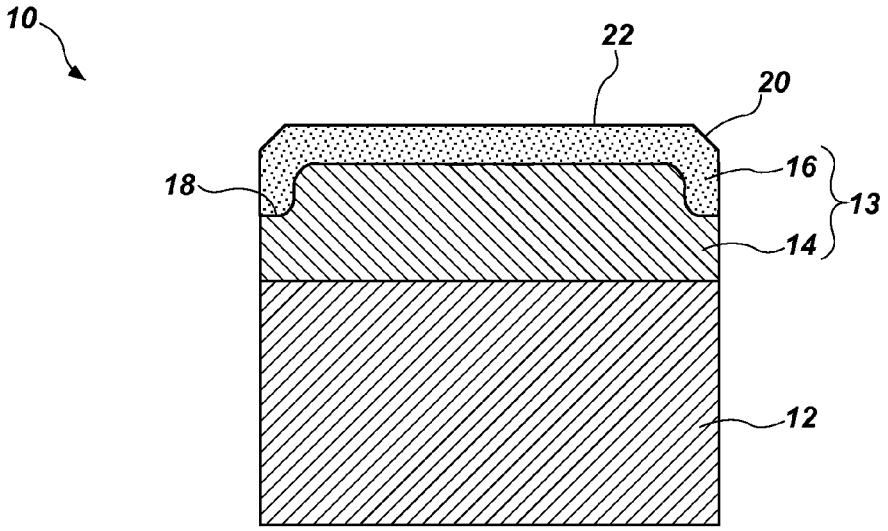
FIG. 1 (PRIOR ART)
FIG. 1 is a simplified cross-sectional side view illustrating a conventional cutting element.

The illustrations presented in this disclosure are not meant to be actual views of any particular earth-boring tool, cutting element, polycrystalline superabrasive material, or component thereof, but are merely idealized representations employed to describe illustrative embodiments. Thus, the drawings are not necessarily to scale. Additionally, elements common between figures may retain the same numerical designation.

Disclosed embodiments relate generally to cutting elements having polycrystalline superabrasive materials that have catalyst materials removed from selected volumes of the polycrystalline superabrasive materials. More specifically, catalyst materials are selectively removed, for example and without limitation by acid leaching, such that during wear of the cutting element, polycrystalline superabrasive material wears without exposing catalyst-containing polycrystalline material through an aperture formed in the catalyst-free polycrystalline material. That is, a wear scar formed does not expose a radially discontinuous portion of the catalyst-containing polycrystalline material. Examples of embodiments of geometries are shown in the FIGS. and described in more detail below. Such cutting elements may exhibit improved resistance to spalling of the polycrystalline material, as well as more favorable wear properties than superabrasive cutting elements having conventional leach profiles.

The terms "earth-boring tool" and "earth-boring drill bit," as used in this disclosure, mean and include any type of bit or tool used for drilling during the formation or enlargement of a wellbore in a subterranean formation and include, for example, fixed-cutter bits, roller-cone bits, percussion bits, core bits, eccentric bits, bicenter bits, reamers, mills, drag bits, hybrid bits, and other drilling bits and tools known in the art.

As used in this disclosure, the term "superabrasive material" means and includes any material having a Knoop hardness value of about 3,000 $Kg_f/mm^2$ (29,420 MPa) or more. Superabrasive materials include, for example, diamond and cubic boron nitride. Superabrasive materials may also be characterized as "superhard" materials.

As used in this disclosure, the term "polycrystalline material" means and includes any material including grains (i.e., crystals) of material that are bonded directly together by intergranular bonds. The crystal structures of the individual grains of the material may be randomly oriented in space within the polycrystalline material.

As used in this disclosure, the terms "intergranular bond" and "interbonded" mean and include any direct atomic bond (e.g., covalent, ionic, metallic, etc.) between atoms in adjacent grains of superabrasive material.

The term "sintering" as used in this disclosure means temperature-driven mass transport, which may include densification and/or coalescing of a particulate component, and typically involves removal of at least a portion of the pores between the starting particles (accompanied by shrinkage) combined with coalescence and bonding between adjacent particles.

As used herein, the terms "catalyst" and "catalyst material" refer to any material capable of catalyzing the formation of intergranular diamond-to-diamond bonds in a diamond grit or powder during an HTHP process in the manufacture of polycrystalline material (e.g., diamond). By way of example, catalyst materials include elements from Groups 8, 9, and 10 of the Periodic Table of the Elements, such as cobalt, iron, nickel, and alloys and mixtures thereof, even when alloyed or mixed with other, noncatalyzing materials.

As used in this disclosure, the term "tungsten carbide" means any material composition that contains chemical compounds of tungsten and carbon, such as WC, $W_2C$, and combinations of WC and $W_2C$. Tungsten carbide includes, for example, cast tungsten carbide, sintered tungsten carbide, and macrocrystalline tungsten carbide.

As used in this disclosure, the terms "at least substantially free of catalyst material," "free of catalyst material," and "catalyst-free" mean that catalyst material has been removed to commercial purity. For example, a volume of material may be at least substantially free of catalyst material even though residual catalyst material may adhere to other materials (e.g., to surfaces of interbonded grains of a superabrasive polycrystalline material) in the volume and isolated volumes of catalyst material may remain in interstitial spaces that are inaccessible by leaching (e.g., because they are closed off by interbonded grains of a superabrasive polycrystalline material and not connected to an otherwise continuous, open network of interstitial spaces among the interbonded grains).

As used herein, the term "contact back rake angle" means an angle of a major, planar portion of a cutting face of a cutting element with respect to a line perpendicular to an anticipated point of contact with a surface of a formation to be engaged by the cutting face of the cutting element. If a cutting element is devoid of a planar portion, the back rake angle means the angle of a plane perpendicular to a centerline of a cutting element with respect to a line perpendicular to a surface of a formation engaged by the cutting face of the cutting element. If a cutting element is configured to have a minor planar portion come in contact with the surface of the formation, the back rake angle means the angle of the minor planar portion with respect to a line perpendicular to a surface of a formation engaged by the cutting face of the cutting element.

Figure 3:
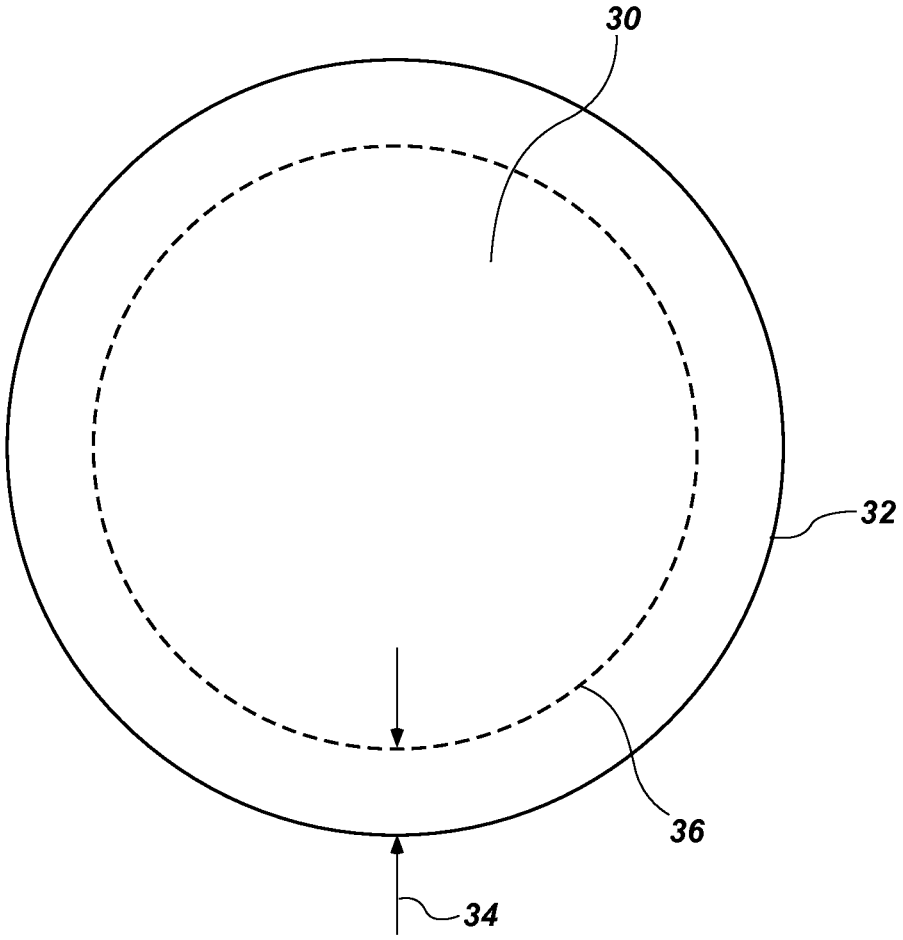
FIG. 3 is a simplified top view illustrating a cutting element.

As used herein, the term "critical failure" means an accumulated chipping, spallation, or material removal of the diamond working surface that exceeds 20% of the radial distance toward the centroid of the cutter as measured from the outer diametrical cutting edge. For example, FIG. 3 shows a cutting surface 30 and an outer diametrical cutting edge 32. A distance 34 inward from the outer diametrical cutting edge 32 defines a boundary 36 within which critical failure may be deemed to have occurred. That is, if accumulated chipping, spallation, or material removal of the cutting surface 30 removes material from within the boundary 36, the accumulated chipping, spallation, or material removal constitutes "critical failure."

Figure 4:
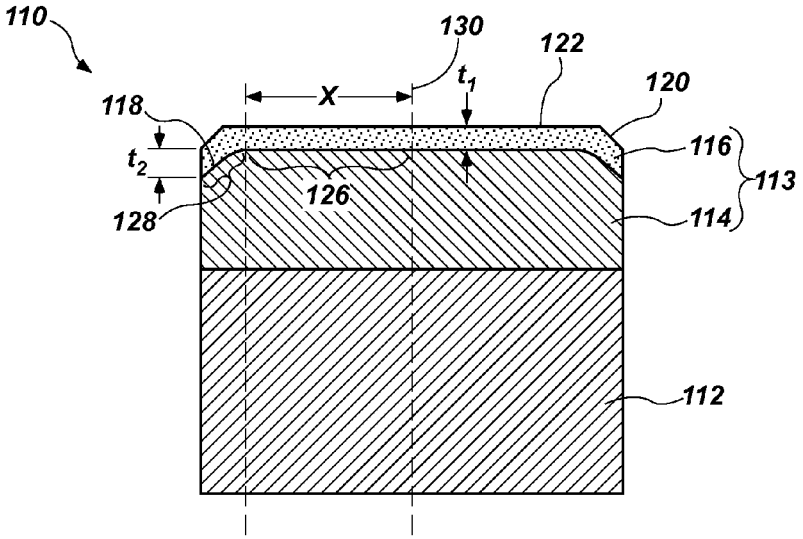
FIG. 4 is a simplified cross-sectional side view illustrating an embodiment of a cutting element according to the present disclosure.

FIG. 4 is a simplified cross-sectional side view illustrating an embodiment of a cutting element 110 according to the present disclosure. The cutting element 110 includes a substrate 112 and a polycrystalline table 113. The polycrystalline table 113 may be diamond or another polycrystalline superabrasive material. The polycrystalline table 113 includes a first volume 114 that includes catalyst material in interstitial spaces among interbonded grains of the polycrystalline material and a second volume 116 that is at least substantially free of catalyst material, with a continuous nonplanar boundary 118 between the first volume 114 and the second volume 116. As used herein, the term "continuous" in reference to the boundary 118 means and includes a boundary 118 free of sharp corners or edges within an area of interest as observed by the unaided eye in a standard optical or SEM micrograph field of view whereby a substantial percent of the area of interest is in the field of view. The polycrystalline table 113 may have one or more chamfers 120 and a cutting face 122. Though the cutting face 122 is illustrated as planar, the cutting face 122 may have any appropriate shape. For example, the cutting face may have a shape as described in U.S. Patent Application Publication No. 2011/0259642, published Oct. 27, 2011, titled "Cutting Elements for Earth-Boring Tools, Earth-Boring Tools Including Such Cutting Elements and Related Methods;" U.S. Patent Application Publication No. 2013/0068534, published Mar. 21, 2013, titled "Cutting Elements for Earth-Boring Tools, Earth-Boring Tools Including Such Cutting Elements and Related Methods; U.S. Patent Application Publication No. 2013/0068537, published Mar. 21, 2013, titled "Cutting Elements for Earth-Boring Tools, Earth-Boring Tools Including Such Cutting Elements and Related Methods; or U.S. Patent Application Publication No. 2013/0068538, published Mar. 21, 2013, titled "Cutting Elements for Earth-Boring Tools, Earth-Boring Tools Including Such Cutting Elements and Related Methods; the entire disclosure of each of which is incorporated herein in its entirety by this reference.

The second volume 116 may have approximately the same thickness across the cutting element 110. For example, the second volume 116 may have a thickness $t_1$, measured near a centerline 130 of the cutting element 110, from about 25 μm to about 750 μm, such as from about 100 μm to about 500 μm. The thickness $t_1$ may be, for example, from about 1% to about 60% of the thickness of the polycrystalline table 113. In some embodiments, the second volume 116 may have a different thickness $t_2$ at the edge of the cutting element 110 than the thickness $t_1$ within the body of the cutting element 110. For example, the second volume 116 may have a thickness $t_2$ at the edge of the cutting element 110 from about 200 μm to about 1,000 μm, such as from about 300 μm to about 500 μm. The thickness $t_2$ may be, for example, from about 2% to about 80% of the thickness of the polycrystalline table 113.

Figure 5A:
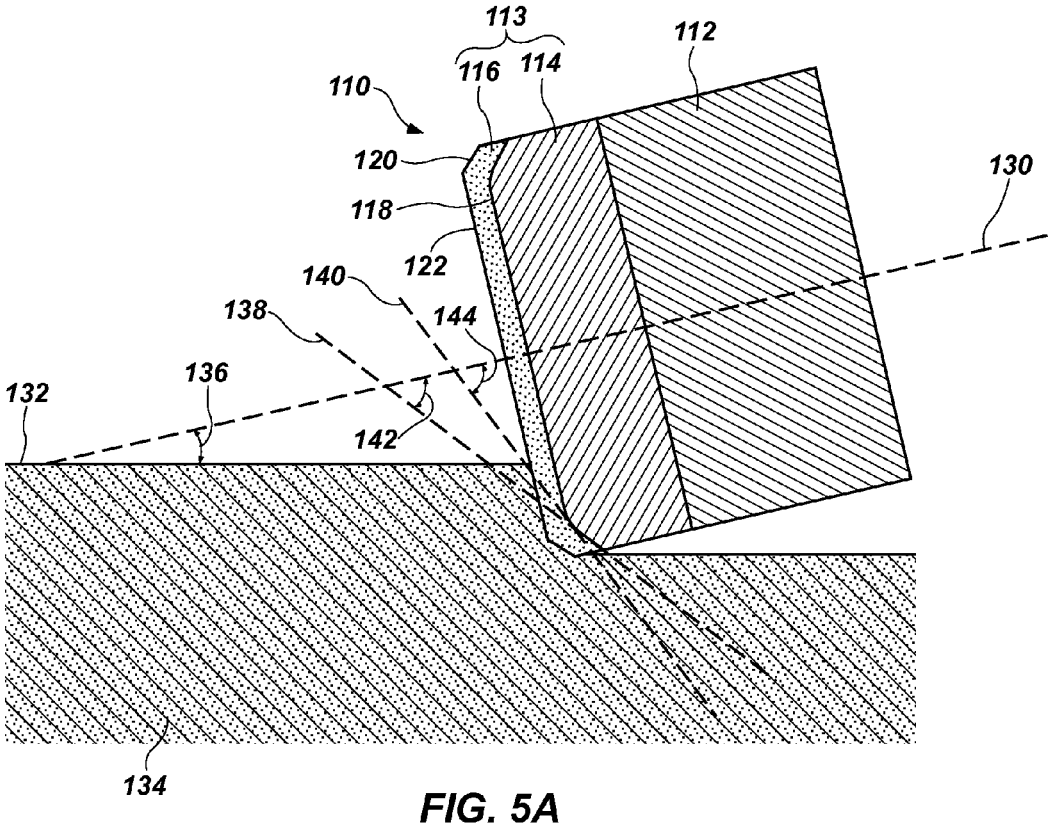
FIG. 5A is another view of the cutting element of FIG. 4 illustrating how the cutting element may engage a subterranean formation.

FIG. 5A is another view of the cutting element 110 of FIG. 4 illustrating how the cutting element 110 may engage a subterranean formation 134. As illustrated in FIG. 5A, the boundary 118 defines a plurality of planes substantially tangent to the boundary 118, and each tangent plane may form an angle greater than a contact back rake angle of the cutting element 110 with the centerline 130 of the cutting element 110. The tangent planes of the boundary 118 may also form an angle greater than an angle defined by a wear scar expected to be formed during a drilling operation and the centerline 130 of the cutting element 110, as discussed in further detail below and shown in FIGS. 7A through 7C. The cutting element 110 may be used to remove material from a surface 132 of the subterranean formation 134. An angle 136 formed by the intersection of the centerline 130 and the surface 132 of a subterranean formation 134 may be referred to in the art as the contact back rake angle. The contact back rake angle 136 may depend on the type of drill bit on which the cutting element 110 is secured, the location of the cutting element 110 on the drill bit, the type of formation 134 to be cut, or other factors. Typical contact back rake angles for drill bits may vary up to about 40°, such as from about 10° to about 50°. In some embodiments, contact back rake angles may be negative.

Figure 5B:
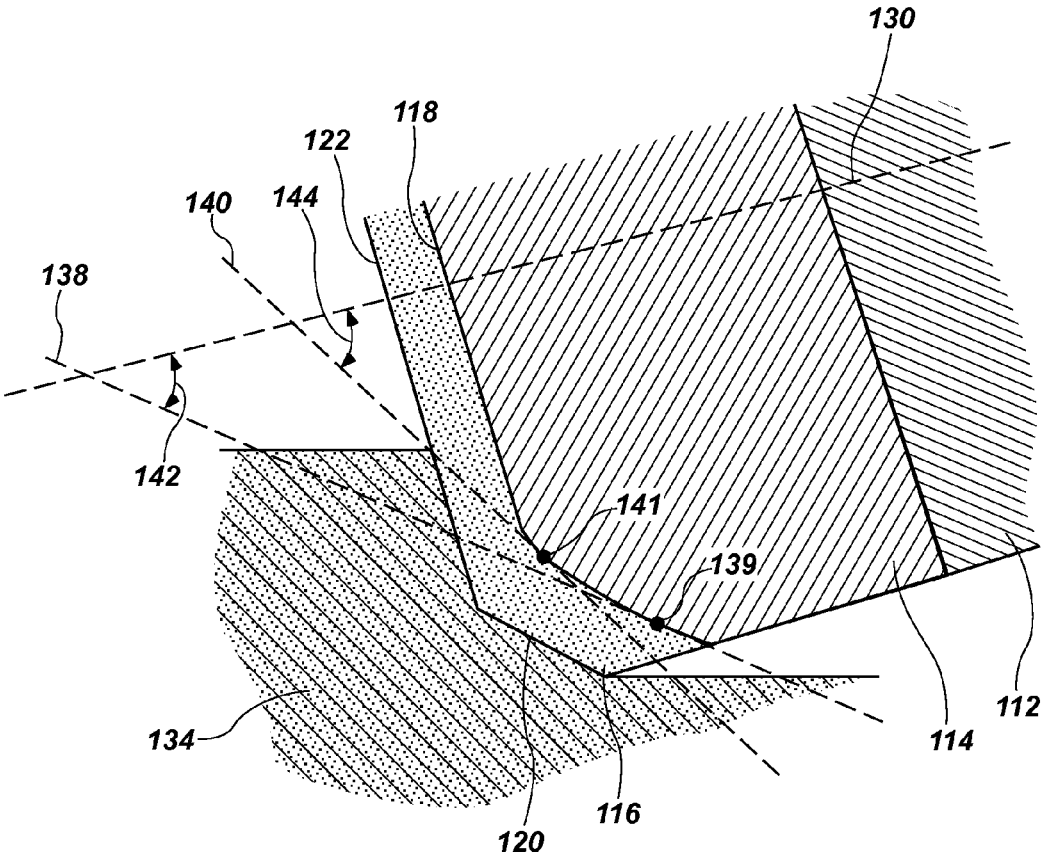
FIG. 5B is an enlarged view showing a portion of the cutting element in the orientation shown in FIG. 5A.

FIG. 5B is an enlarged view of a portion of the cutting element 110 in the orientation shown in FIG. 5A. Lines 138 and 140 in FIGS. 5A and 5B are lines parallel to the plane of view of FIGS. 5A and 5B in each of two planes tangent to the boundary 118. That is, the lines 138 and 140 are tangent the boundary 118 at points 139 and 141, respectively, in a cross-sectional plane (the plane of view of FIGS. 4, 5A, and 5B) that includes the centerline 130 of the cutting element 110 and the anticipated point of contact of the cutting element 110 with for surface 132 of the formation 134. Similar lines could be drawn at any point along the boundary 118 corresponding to other tangent lines and planes. The lines 138 and 140 intersect the centerline 130 of the cutting element 110 at angles 142 and 144, respectively. The angles 142 and 144 are each greater than the contact back rake angle 136 of the cutting element 110 and less than or equal to 90°. The boundary 118 between the first volume 114 and the second volume 116 may be shaped such that any tangent plane intersects the centerline 130 of the cutting element 110 with an angle greater than the contact back rake angle 136 and less than or equal to 90°.

The boundary 118 between the first volume 114 and the second volume 116 may generally have a roughness at least partially defined by the microstructure of the polycrystalline table 113. Fine-grained and uniformed materials may exhibit a smoother or more uniform boundary, and coarse-grained materials may exhibit a rougher boundary. Some irregularity of the boundary 118 may also be attributable to different particle sizes in various regions of the polycrystalline table 113.

The boundary 118 may be shaped such that a portion thereof forms a substantially frustoconical shape (i.e., the shape of a portion of a cone whose tip has been truncated by a plane parallel to the base of the cone). As shown in FIG. 4, the portion of the boundary 118 adjacent an outer wall of the cutting element 110 may be frustoconical, and the portion of the boundary 118 in the center of the cutting element 110 may be substantially planar, although nonplanar, non-uniform, and highly irregular boundaries between polycrystalline tables and substrates are known. The frustoconical shape may have an axis of revolution that corresponds with the centerline 130 of the cutting element 110. The interface between the frustoconical and planar portions of the boundary 118 may be radiused or otherwise arcuate, such that the boundary 118 has no discontinuities or sharp edges within the cutting element 110. Though idealized as substantially frustoconical in shape in FIG. 4, the boundary 118 may not be uniform around the cutting element 110, due to variations in production (e.g., differences in particle sizes, differences in temperature, concentration, or flow of leaching agent, etc.).

Figure 8:
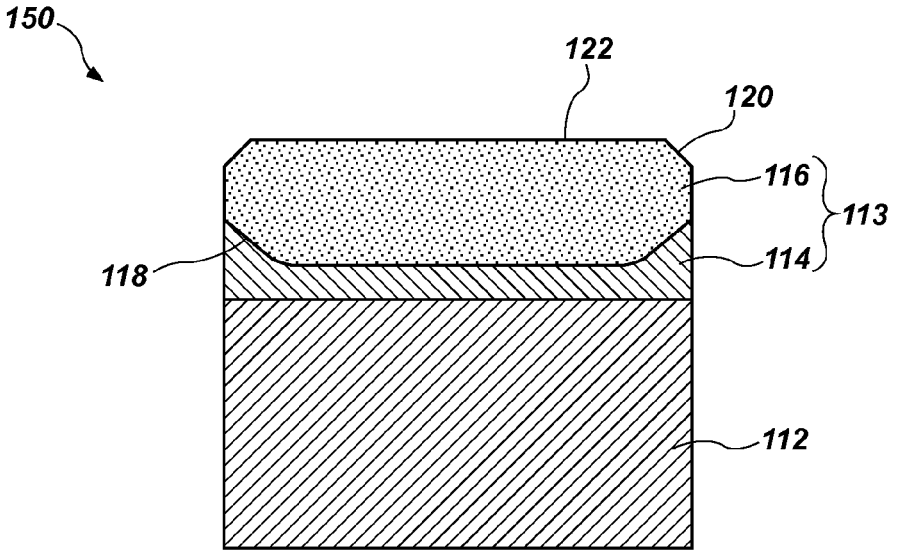
FIGS. 8 through 11 are simplified cross-sectional side views illustrating additional embodiments of cutting elements according to the present disclosure.
Figure 9:
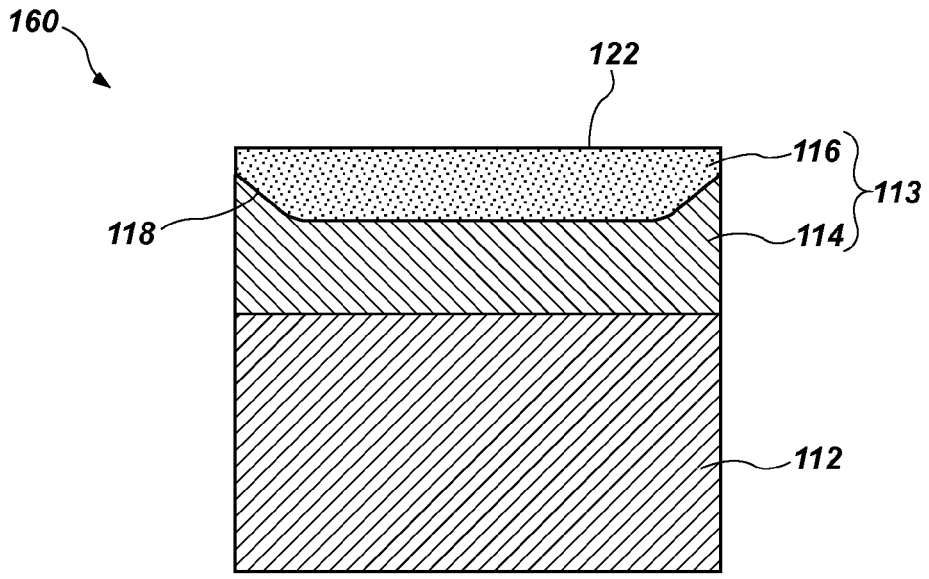

The boundary 118 shown in FIG. 4 generally corresponds to the shape of the chamfer 120 and the cutting face 122. Thus, the boundary 118 is generally flat toward the center of the cutting element 110 and sloping downward (in the orientation of FIG. 4) at approximately the same radial distance as the chamfer 120. The boundary 118 may lack corners and inflection points, such that the intersection between the tangent planes defined by the boundary 118 and the centerline 130 are all on a single side of the boundary 118—the side of the boundary 118 adjacent the second volume 116. In other embodiments, and as shown in FIGS. 8 and 9 and discussed below, the intersection between the tangent planes defined by the boundary 118 and the centerline 130 may be on the side of the boundary 118 adjacent the first volume 114.

The boundary 118 shown in FIG. 4 may be defined as including a first area 126 (which may be an inner area if the cutting element 110 is cylindrical) and a second area 128 (which may be an outer area if the cutting element 110 is cylindrical). The first area 126 may be defined as a portion of the boundary 118 within a first radial distance x of the centerline 130 of the cutting element 110 (e.g., an axis of rotation if the cutting element 110 is cylindrical) and the second area 128 may be defined as a portion of the boundary 118 between the first radial distance x from the centerline 130 of the cutting element 110 and a lateral exterior surface of the cutting element 110. The first radial distance x may be at least 50% of the radius of the cutting element 110, such as at least 75%, at least 90%, or even at least 95% of the radius of the cutting element 110. The difference between the radius of the cutting element 110 and the first radial distance x may be at least the radial width of the chamfer 120, at least 150% of the radial width of the chamfer 120, or even at least 200% of the radial width of the chamfer 120.

Figure 7A:
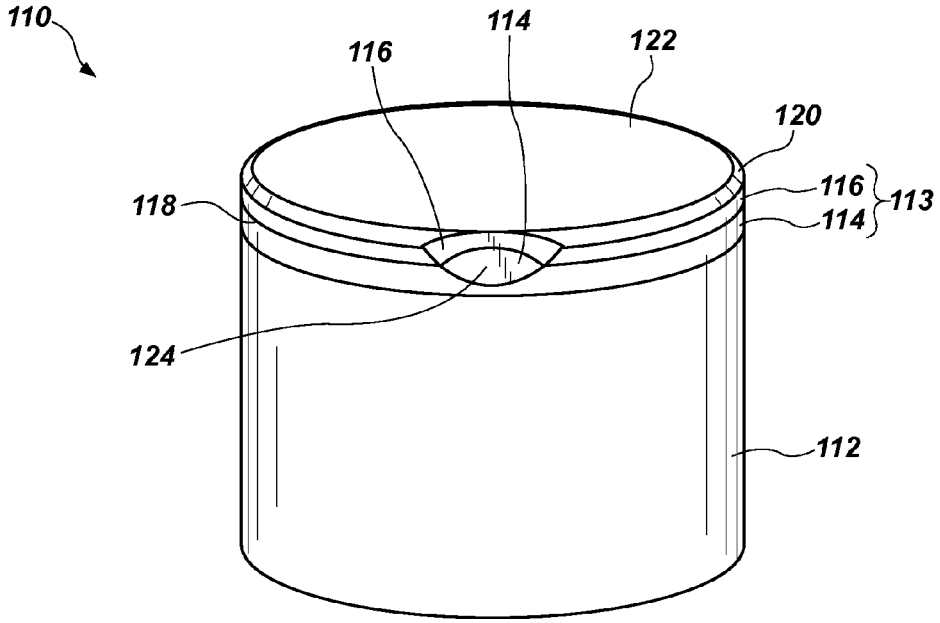
FIGS. 7A through 7C are perspective views illustrating how the cutting element of FIG. 4 may appear after use in cutting a subterranean formation.
Figure 7B:
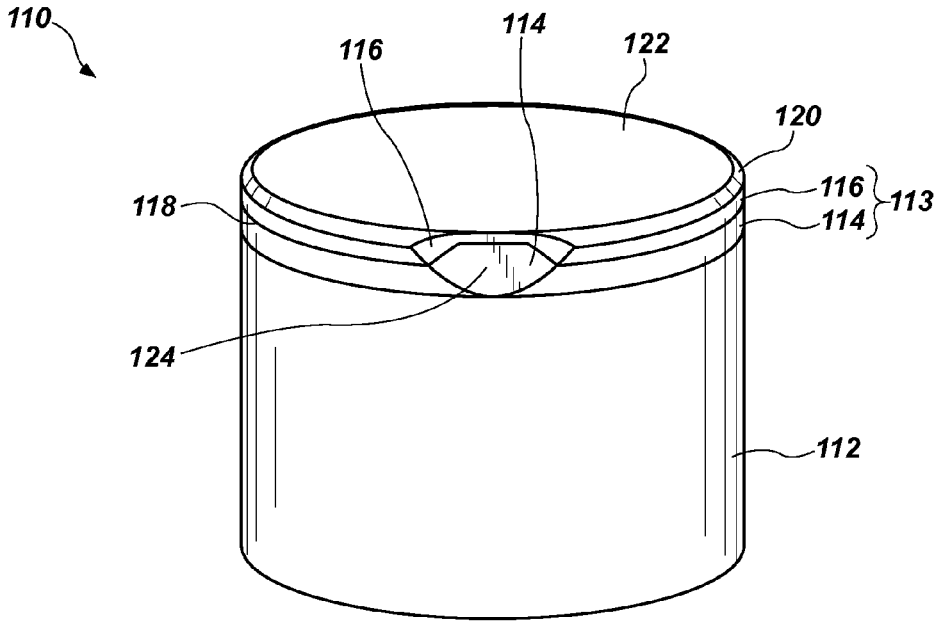
Figure 7C:
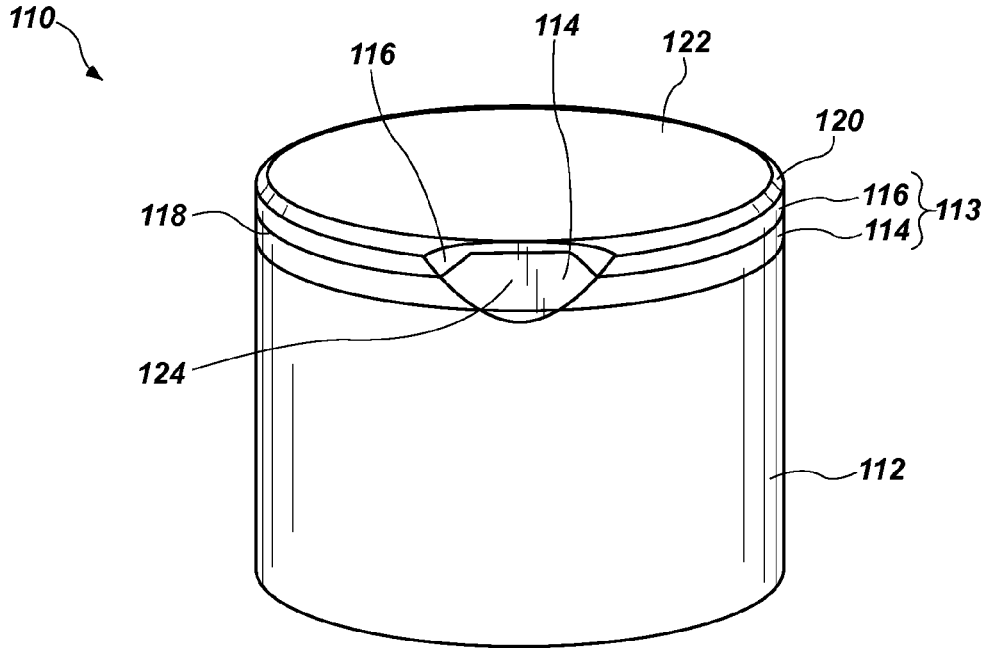

In some embodiments, the second volume 116 may include an annular volume adjacent to and extending along a peripheral surface of the cutting element 110 from a working surface of the cutting element 110 (e.g., the chamfer 120 and/or the cutting face 122) to the boundary 118. Such an annular volume may be referred to in the art as an "annulus leach." As discussed above, a portion of the boundary 118 in the second area 128 defines a plurality of planes tangent to the boundary 118, wherein each tangent plane forms an angle with the centerline 130 of the cutting element 110 greater than the contact back rake angle 136 of the cutting element 110. In the first area 126, the boundary 118 may have any selected shape. For example, the boundary 118 may have an undulating shape in the first area 126, such as described in U.S. patent application Ser. No. 14/248,068, filed Apr. 8, 2014, now U.S. Pat. No. 9,605,488, issued Mar. 28, 2017, and titled "Cutting Elements including Undulating Boundaries Between Catalyst-Containing and Catalyst-Free Regions of Polycrystalline Superabrasive Materials and Related Earth-Boring Tools and Methods," which is incorporated herein in its entirety by this reference. Without being bound to any particular theory, the angle of the tangent planes near the cutting edge may have a relatively greater influence on the durability of the cutting element 110 than the angle of the tangent planes near the center of the cutting element 110 due to the way materials are exposed by a wear scar 124, as shown in FIGS. 7A-7C and discussed below.

In some embodiments, the boundary 118 between the first volume 114 and the second volume 116 of the polycrystalline table 113 defines a plurality of tangent planes (e.g., planes containing lines 138 and 140) that each form angles 142, 144 with the centerline of the cutting element of greater than 20°, greater than 30°, or even greater than 45°.

Figure 6:
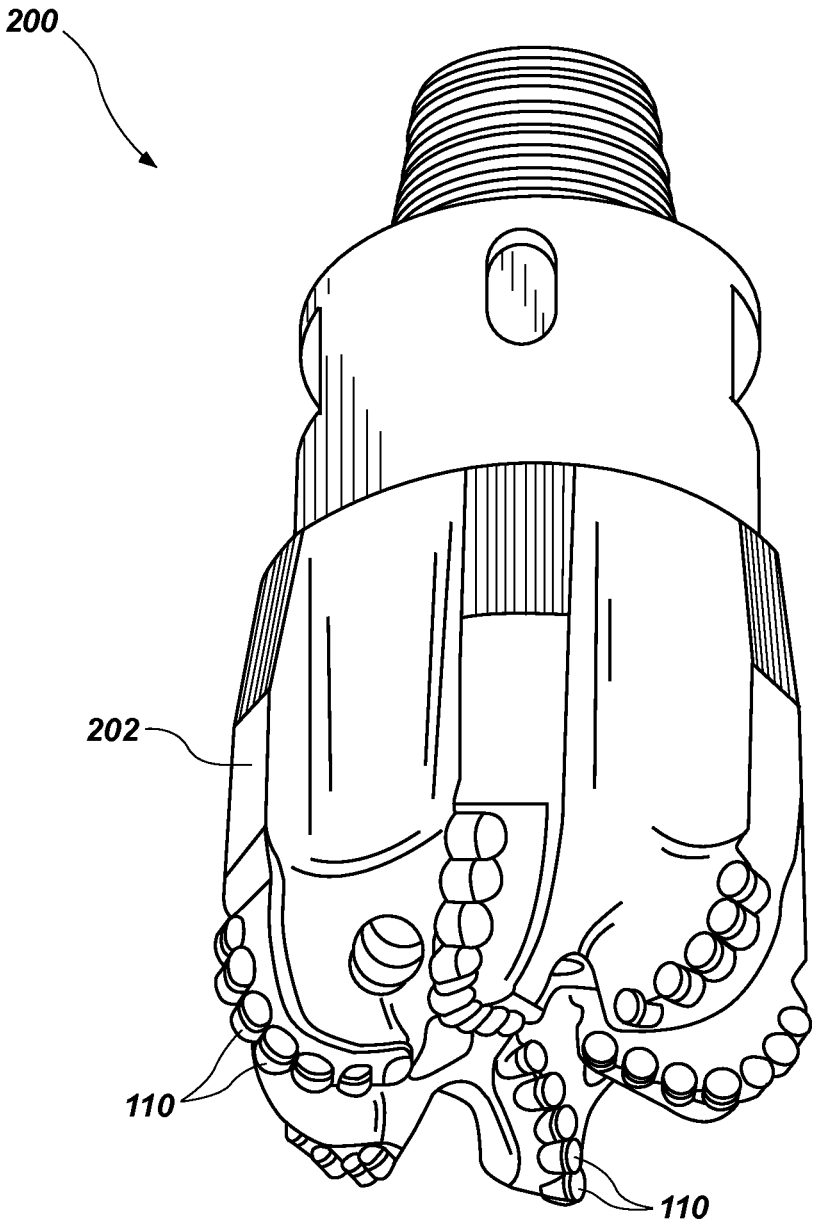
FIG. 6 is an earth-boring tool having cutting elements as shown in FIG. 4.

An earth-boring tool may be formed by securing a polycrystalline cutting element formed as described herein to a bit body. As a non-limiting example, FIG. 6 illustrates a fixed-cutter earth-boring rotary drill bit 200 that includes a plurality of cutting elements 110. The earth-boring rotary drill bit 200 includes a bit body 202, and the cutting elements 110 are bonded to the bit body 202. The cutting elements 110 may be brazed or otherwise secured within pockets formed in the outer surface of the bit body 202. The cutting elements 110 may be secured to have an appropriate contact back rake angle 136 as described above.

Figure 2A:
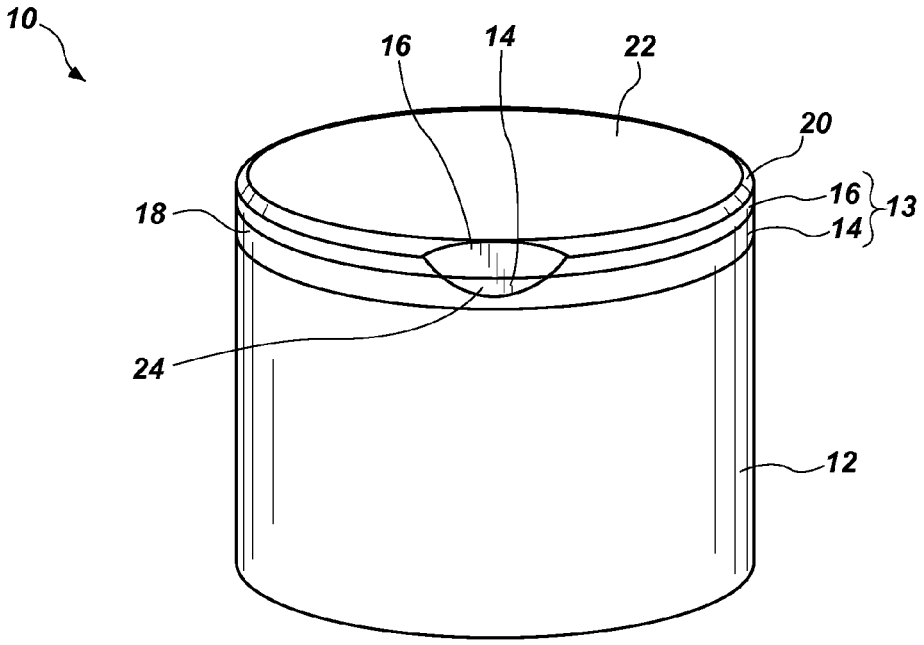
FIG. 2A (PRIOR ART)
FIGS. 2A through 2C are perspective views illustrating how the cutting element of FIG. 1 may appear after use in cutting a subterranean formation.
Figure 2B:
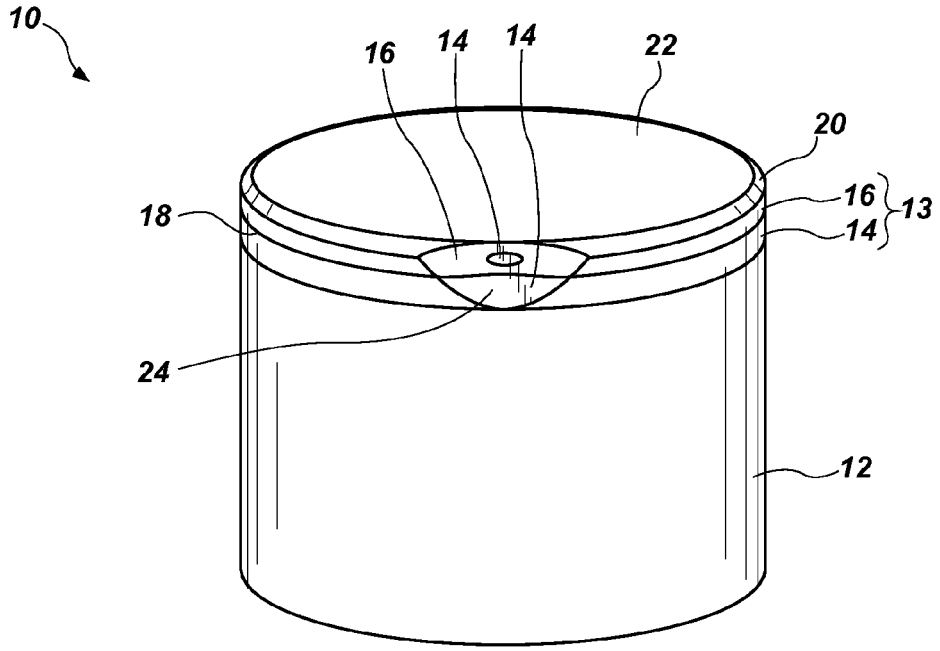
FIG. 2B (PRIOR ART)
Figure 2C:
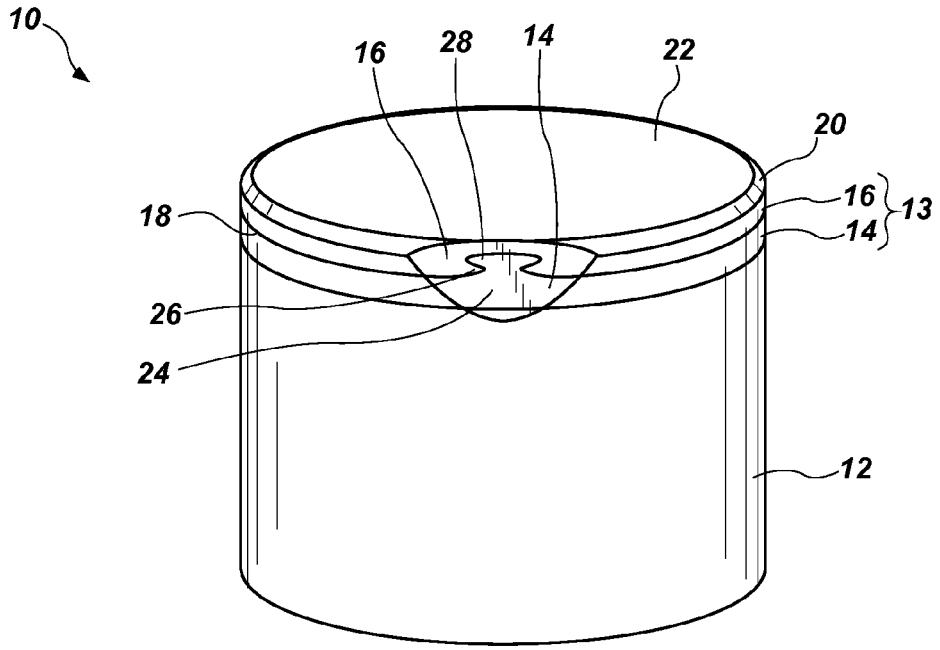
FIG. 2C (PRIOR ART)

Cutting elements 110 and earth-boring rotary drill bits 200 as described herein may be used for forming a wellbore by contacting the earth-boring rotary drill bit 200 and its cutting elements 110 with a surface 132 of a subterranean formation 134 (see FIG. 5A). Abrasion between the cutting elements 110 and the subterranean formation 134 may remove at least a portion of the second volume 116 of the polycrystalline table 113 without exposing the first volume 114 through an aperture formed in the second volume 116. A portion of the first volume 114 adjacent to and in contact with a previously exposed portion of the first volume 114 (e.g., a sidewall of the first volume 114) may be also be removed. Removal is illustrated in the perspective views shown in FIGS. 7A through 7C, after various periods of use in cutting a subterranean formation. A wear scar 124 (i.e., a surface formed by the removal of material of the cutting element 110) may begin to appear at an edge of the cutting element 110, beginning with the second volume 116 of the polycrystalline table 113. FIGS. 7A through 7C illustrate a progression of how the wear scar 124 may form. As the wear scar 124 grows larger, some of the first volume 114 of the polycrystalline table 113 may be removed, but the exposed portions of the first volume 114 and second volume 116 may each remain continuous. Throughout the formation of the wear scar 124, the wear scar 124 may be free of apertures, protrusions, or alcoves defining the different materials of the cutting element 110 (in contrast to the wear scar 24 of a conventional cutting element 10, having an aperture as shown in FIG. 2B, and protruding areas 26 and alcove 28 in FIG. 2C). Thus, as the wear scar 124 enlarges, the cutting performance may change more slowly than in conventional cutting elements 10. The wear scar 124 may progress without rendering any portion of the second volume 116 radially discontinuous from a remainder of the second volume 116. That is, in a view of any section plane through the centerline 130 of the cutting element 110, the first volume 114 and the second volume 116 may each be continuous. The wear scar 124 and the centerline 130 (see FIG. 4) of the cutting element 110 may define an angle less than the angles formed by the tangent planes of the boundary 118 and the centerline 130. Thus, the portion of the first volume 114 newly exposed by the wear scar 124 may appear first adjacent the sidewall of the cutting element 110.

FIGS. 8 through 11 are simplified cross-sectional side views illustrating additional embodiments of cutting elements according to the present disclosure. In the cutting elements 150 and 160 of FIGS. 8 and 9, respectively, the boundaries 118 between the first volumes 114 and the second volumes 116 of the polycrystalline table 113 are oriented in the opposite direction as the boundary 118 shown in FIG. 4. In such embodiments, the intersection between the tangent planes defined by the boundaries 118 and the centerlines 130 may be on the side of the boundaries 118 adjacent the first volumes 114. The cutting element 160 has a cutting face 122 that extends all the way across the front of the cutting element 160 to the sidewalls, without a chamfer 120.

Figure 10:
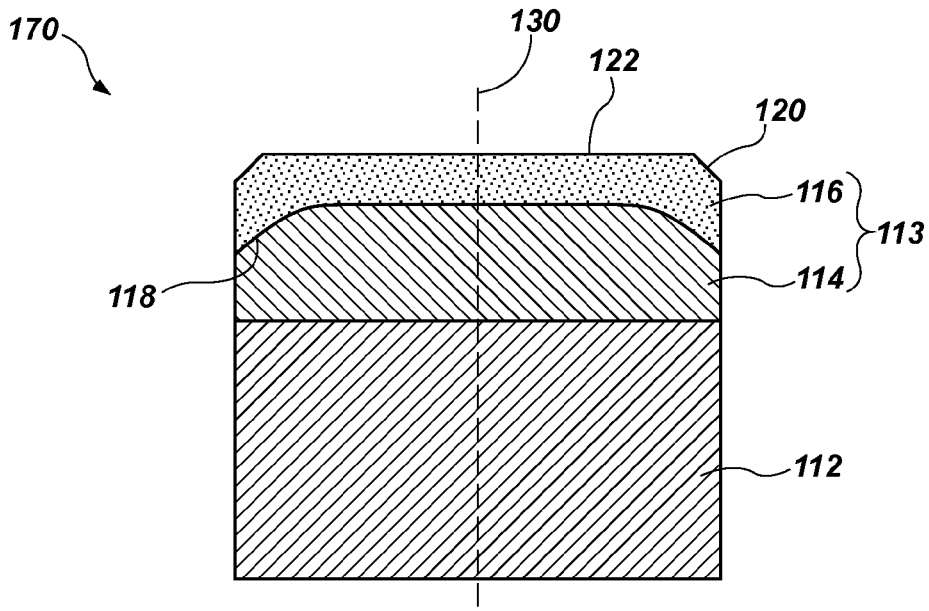

In the cutting element 170 shown in FIG. 10, at least a portion of the boundary 118 forms a paraboloid of revolution (i.e., a shape corresponding to a portion of a parabola rotated about an axis). For example, the paraboloid of revolution may have an axis of revolution substantially coincidental with the centerline 130 of the cutting element. Another portion of the boundary 118, such as the portion toward the centerline 130, may be flat or any other shape.

Figure 11:
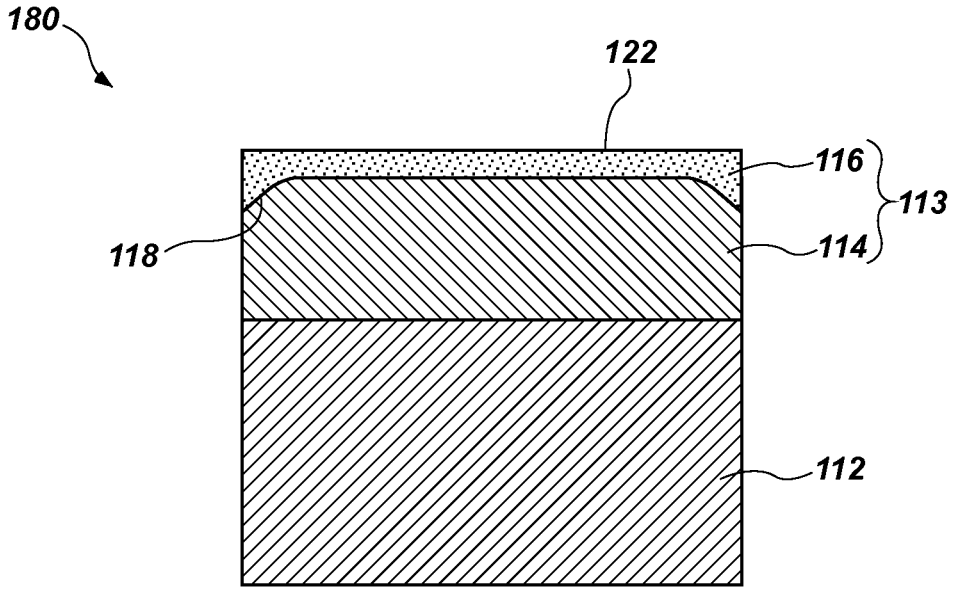

In the cutting element 180 shown in FIG. 11, the boundary 118 between the first volume 114 and the second volume 116 is shaped similar to the boundary 118 shown in FIG. 4. However, the cutting element 160 has no significant chamfer, but a planar cutting face 122 that extends all the way across the front of the cutting element 160 to the sidewalls, without a chamfer 120.

Any of the cutting elements 150, 160, 170, 180 may be used with the earth-boring tool 200 or any other earth-boring tool, instead of or in addition to the cutting element 110. Furthermore, various other geometries may be selected for cutting elements and boundaries 118 based on the embodiments and principles disclosed herein.

To form the cutting elements 110, 150, 160, 170, 180 disclosed herein, portions of the polycrystalline table 113 and the substrate 112 may be masked, and the cutting elements 110, 150, 160, 170, 180 may be at least partially placed in a corrosive material, such as an acid. For example, portions of the polycrystalline table 113 may be protected from the corrosive material by a seal or o-ring before the cutting elements 110, 150, 160, 170, 180 are exposed to the corrosive material.

Catalyst material may be selectively removed from certain portions of the polycrystalline table 113 to define the boundary 118 by, for example, targeted laser, ion, or focused particle beam removal of the catalyst material to differing depths or by selective masking and leaching of different portions of the polycrystalline table 113. In embodiments that include leaching, masking material may be selectively added or removed during the leaching process to facilitate formation of a boundary 118 having a selected shape. In some embodiments, the boundary 118 may be formed by a processes for selectively removing catalyst material to different depths within a polycrystalline superabrasive material as disclosed in U.S. patent application Ser. No. 13/947,723, filed Jul. 22, 2013, now U.S. Pat. No. 9,534,450, issued Jan. 3, 2017, titled "Thermally Stable Polycrystalline Compacts for Reduced Spalling Earth-Boring Tools Including Such Compacts, and Related Methods," the disclosure of which is incorporated herein in its entirety by this reference.

EXAMPLES

Example 1: Conventional Annulus Leach

A cutting element was formed having polycrystalline diamond over a substrate, the polycrystalline diamond having a leach profile substantially as shown in FIG. 1. The cutting element was installed in a test fixture, which was mounted in a vertical turret lathe as is customary in the industry, designed to simulate subterranean drilling. The cutting element was subjected to wear until critical failure was observed. The cutting element endured the equivalent of approximately 93 trips and had a wear scar area at failure of about 0.017 $in^2$.

Example 2: Modified Leach Profile

A cutting element was formed having polycrystalline diamond over a substrate, the polycrystalline diamond having a leach profile substantially as shown in FIG. 4. The leach depth in the center of the cutting element was approximately equal to the leach depth of the cutting element tested in Example 1. The cutting element was installed in a test fixture and tested as described in Example 1. The cutting element endured the equivalent of approximately 175 trips and had a wear scar area at failure of about 0.023 $in^2$. Thus, the cutting element of Example 2 exhibited vastly increased performance, determined by its ability to cut further and develop a larger wear flat before experiencing a critical failure, over the cutting element of Example 1 with a small change to the leach profile.

Additional non limiting example embodiments of the disclosure are described below.

Embodiment 1

An earth-boring tool, comprising a bit body and a cutting element secured to the bit body. The cutting element exhibits a contact back rake angle with respect to a surface of a formation to be cut by the bit body and comprises a polycrystalline superabrasive material. The polycrystalline superabrasive material comprises a first volume including catalyst material in interstitial spaces among interbonded grains of the polycrystalline superabrasive material, a second volume at least substantially free of catalyst material in the interstitial spaces among the interbonded grains of the polycrystalline superabrasive material, and a continuous boundary between the first volume and the second volume of the polycrystalline superabrasive material. The boundary is nonlinear in a cross-sectional plane that includes a centerline of the cutting element and an anticipated point of contact of the cutting element with the surface of the formation to be cut by the earth-boring tool. Each line tangent the boundary in the cross-sectional plane forms an angle with the centerline of the cutting element greater than the contact back rake angle of the cutting element.

Embodiment 2

The earth-boring tool of Embodiment 1, wherein at least a portion of the boundary forms a frustoconical shape.

Embodiment 3

The earth-boring tool of Embodiment 2, wherein the frustoconical shape has an axis of revolution substantially coincidental with the centerline of the cutting element.

Embodiment 4

The earth-boring tool of Embodiment 1, wherein at least a portion of the boundary forms a paraboloid of revolution.

Embodiment 5

The earth-boring tool of Embodiment 4, wherein the paraboloid of revolution has an axis of revolution substantially coincidental with the centerline of the cutting element.

Embodiment 6

The earth-boring tool of any of Embodiments 1 through 5, wherein each tangent line in the cross-sectional plane intersects the centerline on a side of the boundary adjacent the second volume.

Embodiment 7

The earth-boring tool of any of Embodiments 1 through 5, wherein each tangent line in the cross-sectional plane intersects the centerline on a side of the boundary adjacent the first volume.

Embodiment 8

The earth-boring tool of any of Embodiments 1 through 7, wherein each tangent line in the cross-sectional plane forms an angle with the centerline of the cutting element of greater than 20°.

Embodiment 9

The earth-boring tool of Embodiment 8, wherein each tangent line in the cross-sectional plane forms an angle with the centerline of the cutting element of greater than 30°.

Embodiment 10

The earth-boring tool of Embodiment 9, wherein each tangent line in the cross-sectional plane forms an angle with the centerline of the cutting element of greater than 45°.

Embodiment 11

The earth-boring tool of any of Embodiments 1 through 10, wherein the second volume includes an annular volume adjacent to and extending along a peripheral surface of the cutting element from a working surface of the cutting element to the boundary between the first volume and the second volume.

Embodiment 12

An earth-boring tool, comprising a bit body and a cutting element secured to the bit body. The cutting element exhibits a contact back rake angle with respect to a surface of a formation to be cut by the bit body and comprises a polycrystalline superabrasive material. The polycrystalline superabrasive material comprises a first volume including catalyst material in interstitial spaces among interbonded grains of the polycrystalline superabrasive material, a second volume at least substantially free of catalyst material in the interstitial spaces among the interbonded grains of the polycrystalline superabrasive material, and a boundary between the first volume and the second volume of the polycrystalline superabrasive material. The boundary comprises a first area and a second area. The first area includes a portion of the boundary within a first radial distance of a centerline of the cutting element in a cross-sectional plane that includes the centerline of the cutting element and an anticipated point of contact of the cutting element with the surface of the formation to be cut by the earth-boring tool. The second area includes a portion of the boundary between the first radial distance from the centerline of the cutting element and a second radial distance from the centerline of the cutting element in the cross-sectional plane. The second radial distance corresponds to an exterior surface of the cutting element, and the first radial distance is at least 50% of the second radial distance. Each line tangent the boundary in the cross-sectional plane in the second area forms an angle with the centerline of the cutting element greater than the contact back rake angle of the cutting element.

Embodiment 13

The earth-boring tool of Embodiment 12, wherein the portion of the boundary in the first area forms a frustoconical shape.

Embodiment 14

The earth-boring tool of Embodiment 13, wherein the frustoconical shape has an axis of revolution substantially coincidental with the centerline of the cutting element.

Embodiment 15

The earth-boring tool of Embodiment 12, wherein the portion of the boundary in the first area forms a paraboloid of revolution.

Embodiment 16

The earth-boring tool of Embodiment 15, wherein the paraboloid of revolution has an axis of revolution substantially coincidental with the centerline of the cutting element.

Embodiment 17

The earth-boring tool any of Embodiments 12 through 16, wherein each line tangent the boundary in the cross-sectional plane intersects the centerline on a side of the boundary adjacent the second volume.

Embodiment 18

The earth-boring tool of any of Embodiments 12 through 16, wherein each line tangent the boundary in the cross-sectional plane intersects the centerline on a side of the boundary adjacent the first volume.

Embodiment 19

The earth-boring tool of any of Embodiments 12 through 18, wherein each line tangent the boundary in the cross-sectional plane forms an angle with the centerline of the cutting element of greater than 20°.

Embodiment 20

The earth-boring tool of Embodiment 19, wherein each line tangent the boundary in the cross-sectional plane forms an angle with the centerline of the cutting element of greater than 30°.

Embodiment 21

The earth-boring tool of Embodiment 20, wherein each line tangent the boundary in the cross-sectional plane forms an angle with the centerline of the cutting element of greater than 45°.

Embodiment 22

A cutting element for an earth-boring tool, comprising a substrate and a polycrystalline superabrasive material secured to the substrate. The polycrystalline superabrasive material comprises a first volume including catalyst material in interstitial spaces among interbonded grains of the polycrystalline superabrasive material, a second volume at least substantially free of catalyst material in the interstitial spaces among the interbonded grains of the polycrystalline superabrasive material, and a boundary between the first volume and the second volume of the polycrystalline superabrasive material. The boundary is nonlinear in a cross-sectional plane that includes a centerline of the cutting element and an anticipated point of contact of the cutting element with the surface of the formation to be cut by the cutting element. Each line tangent the boundary in the cross-sectional plane forms an angle with the centerline of greater than 20°.

Embodiment 23

The cutting element of Embodiment 22, wherein at least a portion of the boundary forms a frustoconical shape.

Embodiment 24

The cutting element of Embodiment 23, wherein the frustoconical shape has an axis of revolution substantially coincidental with the centerline of the cutting element.

Embodiment 25

The cutting element of Embodiment 22, wherein at least a portion of the boundary forms a paraboloid of revolution.

Embodiment 26

The cutting element of Embodiment 25, wherein the paraboloid of revolution has an axis of revolution substantially coincidental with the centerline of the cutting element.

Embodiment 27

The cutting element of any of Embodiments 22 through 26, wherein each line tangent the boundary in the cross-sectional plane intersects the centerline on a side of the boundary adjacent the second volume.

Embodiment 28

The cutting element of any of Embodiments 22 through 26, wherein each line tangent the boundary in the cross-sectional plane intersects the centerline on a side of the boundary adjacent the first volume.

Embodiment 29

The cutting element of any of Embodiments 22 through 28, wherein each line tangent the boundary in the cross-sectional plane forms an angle with the centerline of the cutting element of greater than 30°.

Embodiment 30

The cutting element of Embodiment 29, wherein each line tangent the boundary in the cross-sectional plane forms an angle with the centerline of the cutting element of greater than 45°.

Embodiment 31

A method of forming a wellbore comprising contacting an earth-boring tool with a surface of a subterranean formation. The earth-boring tool comprises a bit body and at least one cutting element secured to the bit body. The at least one cutting element comprises a polycrystalline superabrasive material comprising a first volume including catalyst material in interstitial spaces among interbonded grains of the polycrystalline superabrasive material and a second volume at least substantially free of catalyst material in interstitial spaces among interbonded grains of the polycrystalline superabrasive material. A surface of the second volume is exposed at least partially around the cutting element. The method further comprises removing at least a portion of the polycrystalline superabrasive material from the second volume through contact with the surface of the subterranean formation and removing a portion of the first volume adjacent to and in contact with the second volume without rendering a portion of the second volume radially discontinuous with a remainder of the second volume.

Embodiment 32

A method of forming a wellbore comprising contacting an earth-boring tool with a surface of a subterranean formation. The earth-boring tool comprises a bit body and a cutting element secured to the bit body. The cutting element comprises a polycrystalline superabrasive material comprising a first volume including catalyst material in interstitial spaces among interbonded grains of the polycrystalline superabrasive material and a second volume at least substantially free of catalyst material in the interstitial spaces among the interbonded grains of the polycrystalline superabrasive material. A surface of the second volume is exposed at least partially around the cutting element. The method further comprises removing a portion of the second volume and removing a portion of the first volume without exposing the first volume through an aperture formed in the second volume.

Embodiment 33

The earth-boring tool, cutting element, or method of any of Embodiments 1 through 32, wherein the polycrystalline superabrasive material comprises diamond.

Embodiment 34

The earth-boring tool, cutting element, or method of any of Embodiments 1 through 32, wherein the polycrystalline superabrasive material comprises cubic boron nitride.

Embodiment 35

The earth-boring tool, cutting element, or method of any of Embodiments 1 through 34, wherein the cutting element further comprises a substrate.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention as contemplated by the inventors. Further, embodiments of the disclosure have utility with different and various types and configurations of tools.

What is claimed is:

1. An earth-boring tool, comprising:

a body; and a cutting element secured to the body, the cutting element exhibiting a contact back rake angle with respect to a surface of a formation to be cut by the cutting element, the cutting element comprising a polycrystalline superabrasive material comprising:

a first volume including catalyst material in interstitial spaces among interbonded grains of the polycrystalline superabrasive material;

a second volume at least substantially free of catalyst material in the interstitial spaces among the interbonded grains of the polycrystalline superabrasive material; and a continuous boundary free of sharp corners and edges as observed by an unaided eye in a standard optical or SEM micrograph field of view between the first volume and the second volume of the polycrystalline superabrasive material, wherein the boundary is nonlinear in a cross-sectional plane that includes a centerline of the cutting element and a point of contact of the cutting element with the surface of the formation to be cut by the cutting element and that extends perpendicular to the surface of the formation to be cut by the cutting element, wherein each point along a length of the boundary defines a single tangent line in the cross-sectional plane, and wherein each tangent line in the cross-sectional plane forms an angle with the centerline of the cutting element greater than the contact back rake angle of the cutting element.

2. The earth-boring tool of claim 1, wherein at least a portion of the boundary forms a frustoconical shape.

3. The earth-boring tool of claim 2, wherein the frustoconical shape has an axis of revolution substantially coincidental with the centerline of the cutting element.

4. The earth-boring tool of claim 1, wherein at least a portion of the boundary forms a paraboloid of revolution.

5. The earth-boring tool of claim 4, wherein the paraboloid of revolution has an axis of revolution substantially coincidental with the centerline of the cutting element.

6. The earth-boring tool of claim 1, wherein each tangent line in the cross-sectional plane forms an angle with the centerline of the cutting element of greater than 30°.

7. The earth-boring tool of claim 1, wherein the second volume includes an annular volume adjacent to and extending along a peripheral surface of the cutting element from a working surface of the cutting element to the boundary between the first volume and the second volume.

8. An earth-boring tool, comprising:

a body; and a cutting element secured to the body, the cutting element exhibiting a contact back rake angle with respect to a surface of a formation to be cut by the cutting element, the cutting element comprising a polycrystalline superabrasive material comprising:

a first volume including catalyst material in interstitial spaces among interbonded grains of the polycrystalline superabrasive material;

a second volume at least substantially free of catalyst material in the interstitial spaces among the interbonded grains of the polycrystalline superabrasive material; and a boundary between the first volume and the second volume of the polycrystalline superabrasive material, wherein:

the boundary comprises:

a first area including a portion of the boundary within a first radial distance of a centerline of the cutting element in a cross-sectional plane that includes the centerline of the cutting element and a point of contact of the cutting element with the surface of the formation to be cut by the cutting element and that extends perpendicular to the surface of the formation to be cut by the cutting element; and a second area including a portion of the boundary between the first radial distance from the centerline of the cutting element and a second radial distance from the centerline of the cutting element in the cross-sectional plane, the second radial distance corresponding to a peripheral surface of the cutting element, wherein the first radial distance is at least 50% of a radius of the cutting element;

wherein each point along a length of the boundary defines a single tangent line in the cross-sectional plane, wherein each tangent line in the cross-sectional plane in the second area forms an angle with the centerline of the cutting element greater than the contact back rake angle of the cutting element and less than 90°.

9. The earth-boring tool of claim 8, wherein the portion of the boundary in the second area forms a frustoconical shape.

10. The earth-boring tool of claim 8, wherein the portion of the boundary in the second area forms a paraboloid of revolution.

11. The earth-boring tool of claim 8, wherein each tangent line in the cross-sectional plane within the portion of the boundary in the second area intersects the centerline on a side of the boundary adjacent the first volume.

12. A cutting element for an earth-boring tool, comprising:

a substrate; and a polycrystalline superabrasive material secured to the substrate, the polycrystalline superabrasive material comprising:

a first volume including catalyst material in interstitial spaces among interbonded grains of the polycrystalline superabrasive material;

a second volume at least substantially free of catalyst material in the interstitial spaces among the interbonded grains of the polycrystalline superabrasive material; and a boundary between the first volume and the second volume of the polycrystalline superabrasive material, wherein the boundary is nonlinear in a cross-sectional plane that includes a centerline of the cutting element and a point of contact of the cutting element with the surface of the formation to be cut by the cutting element and that extends perpendicular to the surface of the formation to be cut by the cutting element, wherein each point along a length of the boundary defines a single tangent line in the cross-sectional plane, the boundary comprising:

a first area including a portion of the boundary within a first radial distance of the centerline of the cutting element in the cross-sectional plane; and a second area including a portion of the boundary between the first radial distance from the centerline of the cutting element and a second radial distance from the centerline of the cutting element in the cross-sectional plane, the second radial distance corresponding to a peripheral surface of the cutting element, wherein each tangent line in the cross-sectional plane within the portion of the boundary in the second area forms an angle with the centerline of greater than 20° and less than 90°.

13. The cutting element of claim 12, wherein the portion of the boundary in the second area forms a frustoconical shape.

14. The cutting element of claim 12, wherein the portion of the boundary in the second area forms a paraboloid of revolution.

15. The cutting element of claim 12, wherein each tangent line in the cross-sectional plane within the portion of the boundary in the second area forms an angle with the centerline of the cutting element of greater than 30° and less than 90°.

16. The cutting element of claim 15, wherein each tangent line in the cross-sectional plane within the portion of the boundary in the second area forms an angle with the centerline of the cutting element of greater than 45° and less than 90°.

17. The earth-boring tool of claim 12, wherein each tangent line in the cross-sectional plane within the portion of the boundary in the second area intersects the centerline on a side of the boundary adjacent the second volume.

18. The earth-boring tool of claim 12, wherein each tangent line in the cross-sectional plane within the portion of the boundary in the second area intersects the centerline on a side of the boundary adjacent the first volume.

19. A method of forming a wellbore, comprising:

contacting an earth-boring tool with a surface of a subterranean formation, wherein the earth-boring tool comprises:

a body; and at least one cutting element secured to the body, the at least one cutting element comprising a polycrystalline superabrasive material comprising:

a first volume including catalyst material in interstitial spaces among interbonded grains of the polycrystalline superabrasive material; and a second volume at least substantially free of catalyst material in interstitial spaces among interbonded grains of the polycrystalline superabrasive material, wherein a surface of the second volume is exposed at least partially around the at least one cutting element;

wherein a boundary between the first volume and the second volume defines a plurality of tangent lines in a cross-sectional plane defined by a centerline of the at least one cutting element and a point of contact of the at least one cutting element with the surface of the formation to be cut by the at least one cutting element and that extends perpendicular to the surface of the subterranean formation, wherein each point along a length of the boundary defines a single tangent line in the cross-sectional plane, wherein each tangent line in the cross-sectional plane forms an angle with the centerline of the at least one cutting element greater than a contact back rake angle of the at least one cutting element;

removing at least a portion of the polycrystalline superabrasive material from the second volume through contact with the surface of the subterranean formation; and removing a portion of the first volume adjacent to and in contact with the second volume without rendering a portion of the second volume radially discontinuous with a remainder of the second volume.

20. A method of forming a wellbore, comprising:

contacting an earth-boring tool with a surface of a subterranean formation, wherein the earth-boring tool comprises:

a body; and a cutting element secured to the body, the cutting element comprising a polycrystalline superabrasive material comprising:

a first volume including catalyst material in interstitial spaces among interbonded grains of the polycrystalline superabrasive material; and a second volume at least substantially free of catalyst material in the interstitial spaces among the interbonded grains of the polycrystalline superabrasive material, wherein a surface of the second volume is exposed at least partially around the cutting element;

wherein a boundary between the first volume and the second volume defines a plurality of tangent lines in a cross-sectional plane defined by a centerline of the cutting element and a point of contact of the cutting element with the surface of the formation, the cross-sectional plane extending perpendicular to the surface of the subterranean formation, wherein each point along a length of the boundary defines a single tangent line in the cross-sectional plane, wherein each tangent line in the cross-sectional plane forms an angle with the centerline of the cutting element greater than a contact back rake angle of the cutting element;

removing a portion of the second volume; and removing a portion of the first volume without exposing the first volume through an aperture formed in the second volume.

* * * * *